US008463615B2

(12) United States Patent
Li et al.

(10) Patent No.: US 8,463,615 B2
(45) Date of Patent: Jun. 11, 2013

(54) LOW-DELAY AUDIO CODER

(75) Inventors: Minyue Li, Stockholm (SE); Willem Bastiaan Kleijn, Stocksund (SE)

(73) Assignee: Google Inc., Mountain View, CA (US)

( * ) Notice: Subject to any disclaimer, the term of this patent is extended or adjusted under 35 U.S.C. 154(b) by 790 days.

(21) Appl. No.: 12/671,631

(22) PCT Filed: Jun. 23, 2008

(86) PCT No.: PCT/EP2008/057970

§ 371 (c)(1),
(2), (4) Date: Feb. 1, 2010

(87) PCT Pub. No.: WO2009/015944

PCT Pub. Date: Feb. 5, 2009

(65) Prior Publication Data

US 2011/0224975 A1 Sep. 15, 2011

Related U.S. Application Data

(60) Provisional application No. 60/935,183, filed on Jul. 30, 2007.

(30) Foreign Application Priority Data

Jul. 30, 2007 (EP) ..... 07113397

(51) Int. Cl.
*G10L 21/00* (2006.01)

(52) U.S. Cl.
USPC ..... 704/500; 704/219; 375/240.11

(58) Field of Classification Search
USPC ..... 704/219, 500; 375/240.11
See application file for complete search history.

(56) References Cited

U.S. PATENT DOCUMENTS 6,115,689 A * 9/2000 Malvar ..... 704/503
6,256,608 B1 * 7/2001 Malvar ..... 704/230

(Continued)

FOREIGN PATENT DOCUMENTS

EP 1 355 298 A2 10/2003

OTHER PUBLICATIONS

Minyue Li et al., "A Low-Delay Audio Coder with Constrained-Entropy Quantization" 2007 IEEE Workshop on Applications of Signal Processing to Audio and Acoustics, Oct. 21-24, 2007, pp. 191-194, XP008087029.

(Continued)

*Primary Examiner* — Daniel D Abebe
(74) *Attorney, Agent, or Firm* — Birch, Stewart, Kolasch & Birch, LLP

(57) ABSTRACT

The present invention relates to methods and devices for encoding and decoding digital audio signals, e.g. a speech signal. An audio coder and a decoder are provided wherein a modeller adds a first distribution model obtained from model parameters of past segments of the digital audio signal and a fixed distribution model, each of the models being multiplied by a weighting coefficient, for obtaining a combined distribution model. The weighting coefficients are selected to minimize a code length of a current segment of the digital audio signal. As the combined distribution model is a sum of several distribution models, wherein at least some of the models is based on the model parameters, flexibility is introduced in the signal model used to encode the digital audio signal. Thus, an audio coder and decoder providing a low bit rate in average, low bit rate variations and low error propagation are provided.

59 Claims, 6 Drawing Sheets

U.S. PATENT DOCUMENTS

| | | | | |
|---|---|---|---|---|
| 7,583,730 | B2 * | 9/2009 | Wu et al. | 375/240.12 |
| 2004/0068401 | A1 * | 4/2004 | Herre et al. | 704/217 |
| 2005/0012648 | A1 | 1/2005 | Marpe et al. | |
| 2005/0031219 | A1 * | 2/2005 | Puri et al. | 382/250 |
| 2007/0016418 | A1 | 1/2007 | Mehrotra et al. | |

OTHER PUBLICATIONS

Matthew V. Mahoney, "Adaptive Weighing of Context Models for Lossless Data Compression" Technical Report CS-2005-16, [Online] 2005, XP002463606, Retrieved from the Internet: URL:http://www.cs.fit/edu/{mmahoney/compression/cs200516.pdf>[retrieved on Dec. 22, 2007].

Jean-Luc Garcia et al., "Backward Linear Prediction for Lossless Coding of Stereo Audio", Audio Engineering Society E-Library, May 8, 2004, XP0102463607, pp. 1-7.

* cited by examiner

LOW-DELAY AUDIO CODER

This application is the National Phase of PCT/EP2008/057970 filed on Jun. 23, 2008, which claims priority under 35 U.S.C. 119(e) to U.S. Provisional Application No. 60/935,183filed on Jul. 30, 2007 and under 35 U.S.C. 119(a) to Patent Application No. 07113397.9 filed in Europe on Jul. 30, 2007, all of which are hereby expressly incorporated by reference into the present application.

FIELD OF THE INVENTION

The present invention relates generally to methods and devices for encoding and decoding audio signals. In particular, the present invention relates to coders and decoders for reducing bit rate variations during the encoding and decoding procedures of speech signals.

BACKGROUND OF THE INVENTION

Coding of a digital audio signal, such as a speech signal, is commonly based on the use of a signal model to reduce bit rate (also called "rate" in the following) and maintain high signal quality. The use of a signal model enables the transformation of data to new data that are more amenable to coding or the definition of a distribution of the digital audio signal, which distribution can be used in coding. In a first example, the signal model may be used for linear prediction, which removes dependencies among samples of the digital audio signal (a method called linear predictive encoding). In a second example, the signal model may be used to provide a probability distribution of a signal segment of the digital audio signal to a quantizer, thereby facilitating the computation of the quantizer which operates either directly on the signal or on a unitary transform of the signal (method called adaptive encoding).

Delay is an important factor in many applications of coding of audio signals. In certain applications, for example those where the user receives an audio signal both through an acoustic path and through a communication-network path, the delay is particularly critical. To limit the delay associated with standard model estimation and transmission methods in such applications, it is common to use backward signal analysis (backward adaptive encoding), in which the model is extracted from previously quantized segments of the digital audio signal (called signal reconstruction in the following).

Coding methods are commonly divided into two classes, namely variable-rate coding, which corresponds to constrained-entropy quantization, and fixed-rate coding, which corresponds to constrained-resolution quantization. The behaviour of these two coding methods can be analysed for the so-called high-rate case, which is often considered to be a good approximation of the low-rate case. A constrained-resolution quantizer minimizes the distortion under a fixed-rate constraint, which, at high rate, results generally in non-uniform cell sizes. In contrast, a constrained-entropy quantizer minimizes the distortion under an average rate (the quantization index entropy) constraint. Thus, in this latter case, the instant rate varies over time, which, at high-rate, generally results in an uncountable set of quantization cells of uniform size and shape while redundancy removal is left to lossless coding.

An advantage of constrained-entropy quantization over constrained-resolution quantization is that it provides a (nearly) constant distortion, which is especially beneficial when the signal model or probabilistic signal model is not optimal. However, a non-optimal probabilistic signal model leads also to an increase in bit rate in the case of constrained-entropy coding. In contrast, constrained-resolution quantization leads to an increased distortion while keeping a constant rate when the probabilistic signal model is not optimal.

Normally, speech and audio signals display so-called transitions, at which the optimal probabilistic signal model would change abruptly. If the model is not updated immediately at a transition, the quality of the encoding degrades in the constrained-resolution case (increased distortion) while the bit rate increases in the constrained-entropy case.

The problem at transitions is particularly significant when the probabilistic signal model is updated by a backward signal analysis. In the case of constrained-resolution quantization, the problem at transitions leads to error propagation since the signal reconstruction is inaccurate because the signal model is inaccurate, and the signal model is inaccurate because the signal reconstruction is inaccurate. Thus, it takes a relatively long time for the coder to retrieve a good signal quality. In the case of constrained-entropy quantization, there is little error propagation but the bit rate increases significantly at abrupt transitions (resulting in bit rate peaks).

Thus, there is a need for providing improved methods and devices for encoding and decoding audio signals, which methods and devices would overcome some of these problems.

SUMMARY OF THE INVENTION

An object of the present invention is to wholly or partly overcome the above disadvantages and drawbacks of the prior art and to provide improved methods and devices for encoding and decoding audio signals.

The present invention provides methods and apparatus enabling to reduce bit rate variation, such as bit rate peaks, when coding an input signal based on variable-rate quantization while maintaining a high average compression rate.

In addition, the methods and apparatus provided by the present invention enable to reduce the propagation of errors caused by packet loss or channel errors, in particular in audio coding of input signal based on fixed-rate quantization, while maintaining high average compression rate.

Hence, according to a first aspect of the present invention, a method for encoding an input signal is provided in accordance with appended claim 1.

According to a second aspect of the present invention, an apparatus for encoding an input signal is provided in accordance with appended claim 16.

According to a third aspect of the present invention, a method for decoding a bit stream of coded data is provided in accordance with appended claim 36.

According to a fourth aspect of the present invention, an apparatus for decoding a bit stream of coded data is provided in accordance with appended claim 46.

According to a fifth aspect of the present invention, a computer readable medium is provided in accordance with appended claim 58.

According to a sixth aspect of the present invention, a computer readable medium is provided in accordance with appended claim 59.

An advantage of the present invention is to remove bit rate peaks associated with transitions in audio coding for constrained-entropy encoding without increasing the average bit rate significantly.

The present invention is based on an insight that the rate increases at transitions because of the non-optimality of the probabilistic signal model obtained with backward adaptation (or backward adaptive encoding). When quantizers are designed based on a probabilistic signal model, their performance varies with the accuracy of the model. Within a given probabilistic model family (e.g., probabilistic signal models that assume that the signal is an independent and identically distributed Gaussian signal filtered by an autoregressive filter structure of a certain model order), the optimal model for a given distortion is the model that provides the lowest bit rate. However, the probabilistic signal model used in backward adaptive encoding is generally not the probabilistic signal model leading to the lowest bit rate, which results in significant rate peaks at transitions.

The present invention is advantageous since flexibility is introduced in the determination of the probabilistic signal model using a low rate of side information. This flexibility is introduced by encoding a current signal segment of the input signal using a combined distribution model obtained by adding at least one first distribution model and at least one fixed distribution model, to which distribution models weighting coefficients are affected. The first distribution model is associated with model parameters extracted from a reconstructed signal generated from past signal segments of the input signal. Thus, the probabilistic signal model or combined distribution model used to encode the current signal segment takes into account past signal segments of the input signal and is also based on other signal models.

In addition, the weighting coefficients affected to the first and the fixed distribution models may be selected for minimizing an estimated code length for the current signal segment.

In other words, the probabilistic model or combined distribution model comprises a sum of probability distributions, which is also referred to as a sum of distribution models, each multiplied by a coefficient. At least one of the distribution models is obtained based on the past coded signal. Good or optimal values for the coefficients may be computed by a modeller.

In order to allow a decoder to reconstruct a probabilistic model generated at an encoder by e.g. a modeller, the probabilistic model is preferably based on at least one of the following: i) a distribution model generated based on a reconstructed signal (which can be available at both the encoder and the decoder), ii) information stored at both the encoder and the decoder (for example a fixed distribution model characteristic of the input signal), and iii) transmitted information. In the present invention, the combined distribution model or probabilistic model may be created by combining, in a manner specified in information transmitted from the encoder to the decoder, a distribution based on a reconstructed signal and one or more fixed distribution models known at both the encoder and the decoder.

According to an embodiment, the combined distribution model may be a mixture model further including at least one adaptive distribution model selected in response to the model parameters extracted from the reconstructed signal, to which adaptive distribution model a weighting factor is affected. This is advantageous since one more component is included in the combined distribution model, thereby increasing the flexibility of the signal model.

According to another embodiment, the combined distribution model is selected from a plurality of combined distribution models in response to a code length of a subsegment of the current signal segment and a code length used for describing the distribution model of the reconstructed signal. The plurality of combined distribution models may be obtained by varying the values of a set of weighting coefficients associated with a particular signal model.

In the present invention, the proposed signal representation, i.e. the combined distribution model, decreases the code length for the signal segments or blocks near transitions for backward adaptive encoding and may also decrease the average rate because the probabilistic signal model is closer to optimal.

The information concerning the values of the weighting coefficients may be transmitted as side information in the form of one or more quantization indices.

The information about the combined distribution model may be transmitted in the form of a model index, which will then be used at a decoder or apparatus for decoding the transmitted data or stored at the encoder.

According to an embodiment, the weighting coefficients may be biased for minimizing the propagation of errors caused by packet loss and channel errors. In particular, the weighting coefficient affected to the first distribution model may be biased towards a value of zero or compared to a threshold value below which it is set to zero.

An advantage of the present invention is to provide methods and devices for encoding and decoding audio signals that present low delay, low bit rate in average and low rate variations.

The present invention is suitable for both constrained-resolution quantization and constrained-entropy quantization.

The invention has broad applications for audio coding, in particular coding based on variable bit rate. It is applicable to low delay audio coding, where backward model adaptation is often selected to reduce the bit rate. Low delay coding is applicable in, for example, a scenario where the listener perceives an audio signal both through an acoustic path and through a communication network or for inter-ear communication for hearing aids, where delay affects spatial perception.

Further objectives of, features of, and advantages with, the present invention will become apparent when studying the following detailed disclosure, the drawings and the appended claims. Those skilled in the art will realize that different features of the present invention can be combined to create embodiments other than those described in the following.

BRIEF DESCRIPTION OF THE DRAWINGS

The above, as well as additional objectives, features and advantages of the present invention, will be better understood through the following detailed description and illustrative drawings, on which.

All the figures are schematic and generally only show parts which are necessary in order to elucidate the invention, wherein other parts may be omitted or merely suggested.

DETAILED DESCRIPTION OF THE INVENTION

Figure 1:
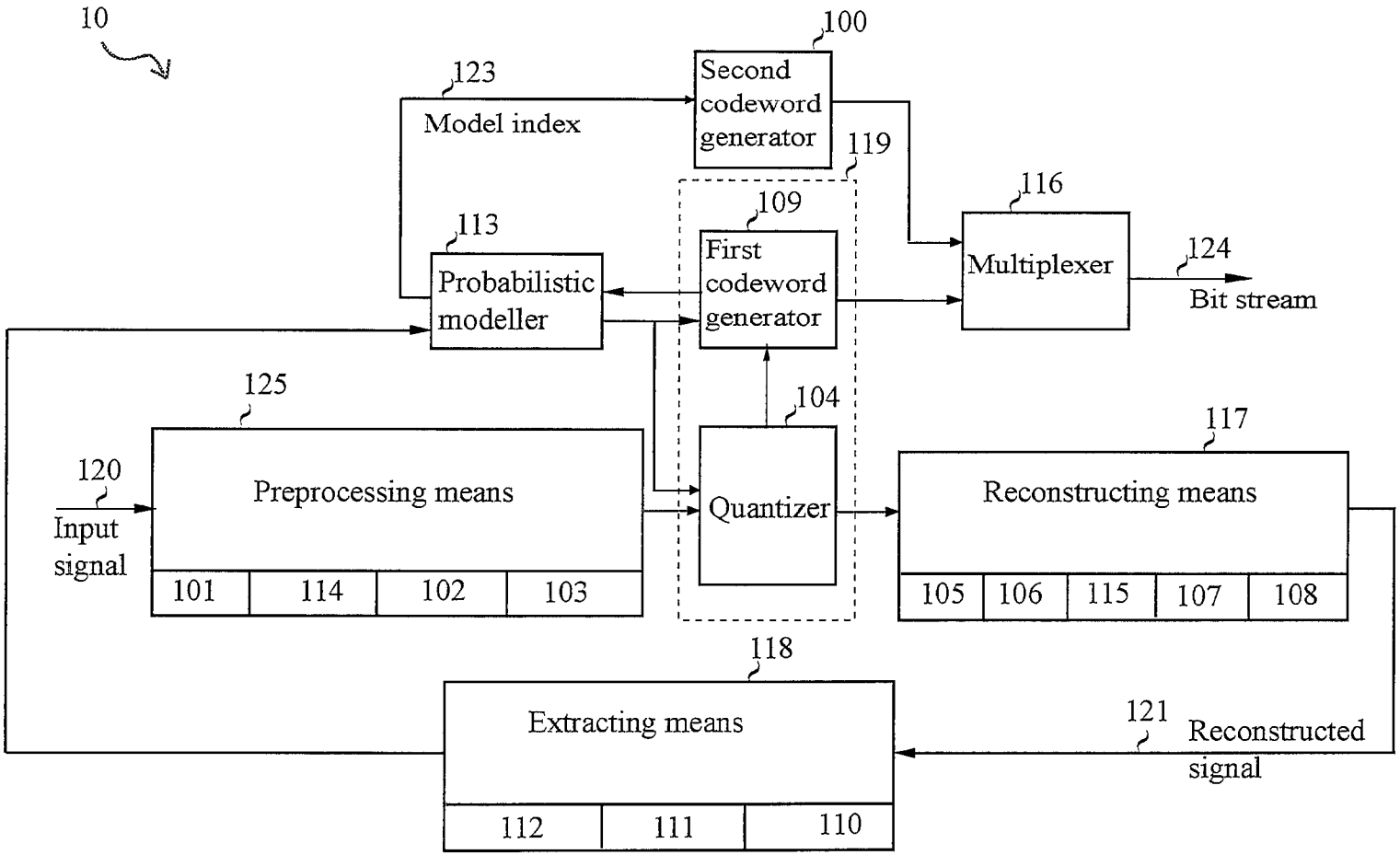
FIG. 1 shows an apparatus for encoding an input signal according to an embodiment of the present invention.

With reference to FIG. 1, a first aspect of the present invention will be described.

FIG. 1 shows an apparatus or system 10 for encoding an input signal 120, such as a digital audio signal or speech signal. The input signal 120 is processed on a segment-by-segment (block-by-block) basis.

A signal model suitable for encoding a current signal segment of the input signal 120 in an encoder 119 is provided by a modeller 113, also called probabilistic modeller 113 in the following. The signal model output from the modeller 113 is also called probabilistic model or combined distribution model in the following and corresponds to a probabilistic model of the joint distribution of the signal samples or segments. The modeller 113 obtains the combined distribution model by adding at least one first distribution model and at least one fixed distribution model, each of the distribution models being multiplied by a weighting coefficient. The first distribution model is associated with model parameters extracted by an extracting means 118 from a reconstructed signal 121, which reconstructed signal 121 is the output of the signal quantizer 104 processed optionally by a reconstructing means or post-processing means 117 to approximate past segments of the input signal 120. Thus, the modeller 113 obtains the combined distribution model by combining at least one first distribution model based on the reconstructed signal 121 and one or more fixed distribution models. Examples of a reconstructing means 117 and an extracting means 118 will be described in more detail with reference to FIG. 2. The structure of the modeller 113 will be explained in more detail with reference to FIG. 5.

The encoding of the current segment of the input signal 120 is performed at the encoder 119 which uses the combined distribution model output from the modeller 113. The encoded signal or sequence of coded data output by the encoder 119 is provided to a multiplexer 116, which generates a bit stream 124. Similarly, information about the combined distribution model is also provided to the multiplexer 116 and included in the bit stream 124.

Optionally, prior to the encoding procedure, the input signal 120 may be pre-processed by a pre-processing means 125, which addresses perceptual and blocking (segmentation) effects. The pre-processing means 125 will be explained in more detail with reference to FIG. 2. The pre-processing means 125 and the post-processing means 117 form a matching pair. If no pre-processing means and post-processing means are used, the output of the quantizer 104 is the quantized speech signal itself.

According to an embodiment, the encoder 119 includes a quantizer 104 and a first codeword generator 109. The quantizer 104 generates indices and the first codeword generator 109 converts a sequence of these indices into codewords. Each codeword may correspond to one or more indices. The quantizer 104 can be either a constrained-resolution quantizer, a constrained-entropy quantizer or any other kind of quantizer. For the purpose of illustration, a constrained-resolution quantizer and a constrained-entropy quantizer are discussed. In the case of constrained-resolution quantization, the number of allowed reconstruction (dequantized) points is fixed and the quantizer 104 is dependent on the combined distribution model, i.e. the quantizer 104 operates using the combined distribution model. In this first case, the first codeword generator 109 generates one codeword per index, and all codewords have the same length in bits. In the case of constrained-entropy quantization, all quantization cells have a fixed size, thereby facilitating the quantization. The size of the quantization cells can be scaled with the variance of the combined distribution model created by the modeller 113 in order to scale the expected distortion with the input signal 120 or can be fixed in order to obtain a fixed distortion. In this second case, the first codeword generator 109 operates using the combined distribution model and generates codewords of unequal length or codewords that describe many indices. The probability of the indices is estimated based on the combined distribution model provided by the modeller 113 in order to generate codewords having minimal average length per index. In this second case, the first codeword generator 109 is set to achieve an encoding having an average rate that is close to the entropy of the indices (which corresponds to a method called entropy coding, also called lossless coding), for which the well-known Huffman or arithmetic coding techniques can be used.

The weighting coefficients affected to each of the distribution models are selected by the modeller 113 for minimizing a code length or estimated code length corresponding to the current signal segment.

The manner of combining the distribution model based on the reconstructed signal 121 of the input signal 120 with the fixed distribution model characteristic of the input signal 120 is specified by a model index 123. Thus, information about the combined distribution model, such as the weighting coefficients affected to each of the distribution models (the first and fixed distribution models), is specified in the model index 123. The model index 123 may be encoded in a second codeword generator 100 and provided to the multiplexer 116 to be included in the bit stream 124. If the lossless coding is used for the first codeword generator 109, it is then preferable to use the same technique for the second codeword generator 100.

Thus, the bit stream 124 includes the encoded signal or sequence of coded data and the information about the combined distribution model used to encode the current signal segment, i.e. the model index 123. The bit stream 124 may then be transmitted to a decoder 30, which will be described with reference to FIG. 3, or stored at the apparatus 10 for encoding.

According to one embodiment, the model index may be transmitted as side information in the form of a coded model index specifying at least the weighting coefficients.

Figure 2:
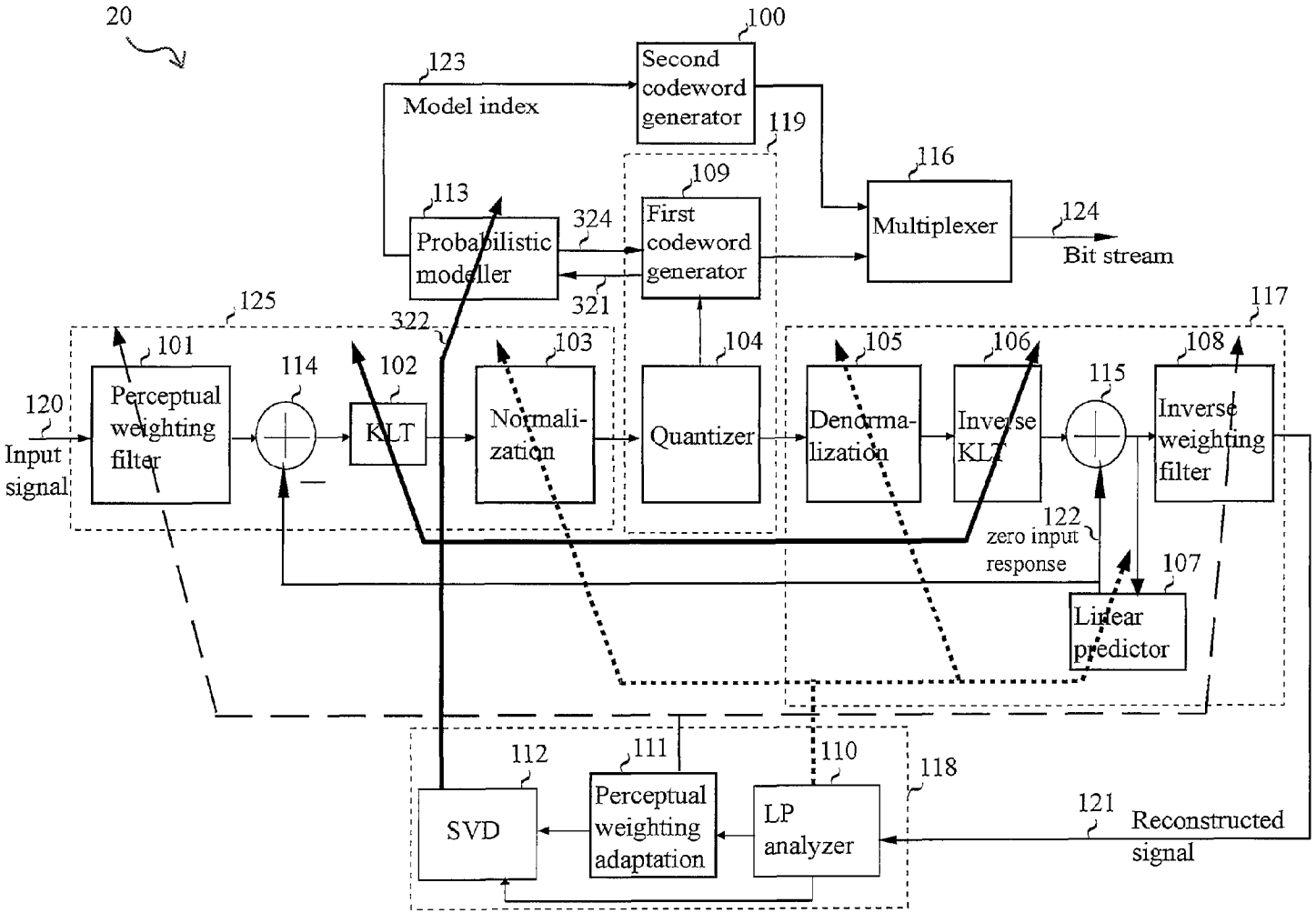
FIG. 2 shows an apparatus for encoding an input signal according to another embodiment of the present invention.

FIG. 2 shows a system or apparatus 20 for encoding an input signal 120, such as a digital audio signal or speech signal, which apparatus 20 is equivalent to the apparatus 10 described with reference to FIG. 1 except that examples of a pre-processing means 125, a reconstructing means 117 and an extracting means 118 are illustrated in more detail. The apparatus 20, as well as the apparatus 10, may be used as a backward adaptive, variable rate, low delay audio coder.

The apparatus 20 for encoding operates also on a block-by-block basis. As an example, the input signal 120 or digital audio signal 120 may be sampled at 16000 Hz, and a typical block size would be 0.25 ms, or 4 samples. The processing steps of the encoder may be summarized as: (1) perceptual weighting, (2) two-stage decorrelation, (3) constrained-entropy quantization, and (4) entropy coding.

For facilitating the processing of the input signal 120, the extracting means 118 includes a linear predictive (LP) analyzer 110 performing a linear predictive analysis (equivalent to a particular estimation method of autoregressive model parameters) of the most recent segment of a reconstructed signal 121 generated from past segments of the input signal 120 in the reconstructing means 117. As an example, the prediction order may be set to 32, thereby capturing some of the spectral fine-structure of the input signal 120. It is preferable for the LP analyzer 110 to operate on the reconstructed signal 121 because no delay is required for the analysis. In addition, a signal similar to the reconstructed signal 121 can also be available at a decoder, such as the decoders 30 or 40 that will be described with reference to FIGS. 3 and 4, respectively, without transmission of side information. The reconstructed signal 121, which is input to the LP analyzer 110 may be first windowed using an asymmetric window as defined in ITU-T Recommendation G.728. The autocorrelation function for the windowed signal is computed and the predictor coefficients may be computed using e.g. the well-known split Levinson algorithm. We denote by A(z) the transfer function of the prediction-error filter corresponding to the set of prediction coefficients extracted by the LP analyzer 110. That is, $A(z)=1-a_1z^{-1} \ldots -a_kz^{-k}$ where $a_1, \ldots, a_k$ are the predictor coefficients and k is the predictor order that is advantageously set to 32. The operation of the pre-processing means 125 is now described in more detail. For each processing block, the signal, i.e. the current signal segment, first passes through a perceptual weighting filter 101. The filtered signal segment may then be corrected by a first correcting means or adder 114 that subtracts a (closed-loop) zero-input response that is described in more detail below, transformed in a transformer 102 and normalized by a normalization means 103. Further, the normalized signal segment may be quantized in the quantizer 104 of the encoder 119 before it enters the reconstructing means 117. It is to be noted that the first correcting means 114 and the normalization means 103 are optional elements of the pre-processing means 125.

The perceptual weighting filter 101 transforms the digital audio signal 120 from a signal domain to a "perceptual" domain, in which minimizing the squared error of quantization approximates minimizing the perceptual distortion. A conventional perceptual weighting filter depends on the autoregressive model of the signal, i.e. the model parameters extracted from the reconstructed signal 121, and has the following transfer function:

$$W(z) = \frac{A(z/\gamma_1)}{A(z/\gamma_2)}, \tag{1}$$

where $\gamma_1$ and $\gamma_2$ are scalars having values comprised between 0 and 1. This filter is computed in perceptual weighting adaptation 111. As an example, these scalars $\gamma_1$ and $\gamma_2$ may be set to 0.9 and 0.7, respectively.

The next two processing steps of the pre-processing means 125 shown in FIG. 2 are a prediction of the segment and a transform of the segment, which both aim at decorrelation, thereby forming a two-stage decorrelation. A first stage is based on linear prediction and a second stage is based on a unitary transform. An advantage provided by linear prediction is the possibility to remove long-range correlations independently of the block length. In contrast, a transform can not remove correlations over separations longer than the block length. Thus, it is preferable to use long blocks in order to remove long-term correlations with a transform. However, long blocks imply long delay. An advantage of transform coding, when based on a unitary transform, is that the shape of the quantization cells is not affected by the transform. This implies that, when the partition (i.e., the quantization cell geometry) is optimized in the transform domain, it is also effectively defined in the perceptual domain. In contrast, conventional predictive coding generally leads to the definition of cell shapes in an excitation domain and this means that the cell shapes are not well controlled. Another advantage of transform coding is that it can benefit of the so-called reverse waterfilling, where the rate is zero in dimensions where the input signal 120 has a lower variance than the signal error. In the example shown in FIG. 2, linear prediction is used to remove inter-block correlations by means of subtracting the zero-input response and unitary transform is used to remove within-block correlations. As another alternative, either one of the linear prediction or the transform may be applied.

The prediction step is carried out by a linear predictor or response computer 107 and the first correcting means or adder 114. The linear prediction of the perceptually weighted signal from the past reconstructed perceptually weighted signal by the linear predictor 107 corresponds to the computation of the zero-input response 122. The zero-input response is the zero input response of a cascade of the inverse of the prediction-error filter and the perceptual weighting filter (see equation (1)): W(z)/A(z). The first correcting means or adder 114 then performs a subtraction of zero-input response 122 for the current signal block or segment. The subtraction of the zero-input response is aimed at removing correlations between adjacent signal blocks (segments).

Upon subtracting the zero input response from the current signal block (segment), the difference, denoted as x, may be modelled as:

$$x=\sigma He, \tag{2}$$

where e is regarded as a white Gaussian process with unit power, σ is the standard deviation of e, and H denotes an impulse response matrix, which matrix has the following form:

$$H = \begin{bmatrix} h_0 & & & \\ h_1 & h_0 & & \\ \vdots & \ddots & \ddots & \\ h_{p-1} & \cdots & h_1 & h_0 \end{bmatrix}, \tag{3}$$

where $\{h_i\}_{i=0}^{p-1}$ are the first p quantities in a normalized unit impulse response sequence of a cascade of the synthesis (inverse prediction-error) filter and the perceptual weighting filter W(z)/A(z) where $h_0$ is set to 1 because of normalization. These p quantities are based on the output of the LP analyzer 110. In addition, a singular value decomposition (SVD) may be performed on H according to equation (4) as follows:

$$H=U\Lambda V, \tag{4}$$

where U and V are unitary matrices, and Λ is a diagonal matrix. This operation is performed in the SVD 112. The matrix U forms a model-based Karhunen-Loève transform (KLT) for the signal x. The KLT is enacted by multiplying the transpose of U on x. Further, a normalization of the result would lead to a unit variance vector s, expressed as:

$$s = \frac{1}{\sigma} U^T x, \tag{5}$$

wherein the covariance of the vector s is expressed as:

$$R=E\{ss^T\}=\Lambda^2. \tag{6}$$

Thus, assuming accuracy of the probabilistic signal model, the components of the vector s are decorrelated, and the variance of each resulting component is defined by the corresponding diagonal element in Λ. The normalization of and equation (6) results in:

$$det(R)=1. \tag{7}$$

For variable-rate (constrained-entropy) coding, it is preferable to use uniform quantization, which is optimal in the high-rate limit. For any particular average rate, a fixed scalar quantizer with uniform quantization step size may be used. The selection of scalar quantization is preferable since, asymptotically with increasing rate, the performance loss will not be more than 0.25 bit per sample over infinite-dimension vector quantization.

In variable-rate coding, either the average rate or the average distortion may be set as a constraint. As an example, the distortion may be set to a constant value equal to an average distortion. For scalar quantization, the average distortion is determined by the step size of the uniform scalar quantizer, which facilitates usage of the apparatus for encoding since one simply selects a step size. For the squared-error criterion, the average distortion is $1/12$ of the square step size. In contrast, the average-rate constraint requires that the combined distribution model is accurate. Thus, it is preferable to use a distortion constraint. Varying the value of the distortion constraint and measuring the resulting average rate over a range of distortions allows the selection of a desired bit rate with a certain numerical precision (distortion).

The first codeword generator 109 may be an entropy coder based on an arithmetic coding method. The entropy coder receives the probability density of the symbols, i.e. the combined distribution model, from the probabilistic modeller 113, the quantized signal values and the quantization step size from the quantizer 104. It is preferable to use an arithmetic coding since it is possible to compute the codeword of a single quantized signal vector s using the combined distribution model without the need of computing other codewords. Thus, if the distribution changes, it is not necessary to update the entire set of all possible codewords in the method of the present invention. This contrasts with Huffman coding where it is most natural to compute the entire set of codewords and store them in a table. For performing arithmetic coding, a cumulative probability function or cumulative distribution is used. For scalar quantization of the transformed segment, the cumulative probability function of each transformed sample suffices for this purpose. To compute a cumulative distribution the quantization values are ordered and the ordering normally coincides with the index values, which are normally selected to be positive consecutive integers. For a quantization value with index m, the cumulative distribution is the sum of the probabilities of the quantization values having an index equal or inferior to m. If the model probability function is selected to be of a simple form, as it generally is the case, then the summation can be replaced by an analytic integration, thereby reducing the computational effort. The arithmetic coding method can be generalized to the vector quantization case, which usually is associated with a truncation of the region of support.

In general, it is preferable to use arithmetic coding if the probability density function changes between coding blocks. If, for instance, a short coding delay is desired, the arithmetic coder buffer depth can be bound using standard methods (e.g., a non-existing source symbol is introduced to enact a flushing of the buffer).

The output of the first codeword generator 109 and the model index 123 output from the second codeword generator 100 are multiplexed in the multiplexer 116 into a bit stream 124. This bit stream 124 may be transmitted to a receiver, such as a decoder, or stored at the apparatus 10 or 20 for encoding. The multiplexing should be done in such a way that the decoder is able to distinguish between the bits describing the model and the bits describing the data. For the constrained-resolution case, where the signal samples and the model index each have fixed codeword length, this is a simple alternation of sets of codewords for a set of signal samples with codewords for a model index. For arithmetic coding, this is most conveniently done by combining the first codeword generator 109 and the second codeword generator 100 into a single codeword generator and interlacing the parameters to be encoded as input to the combined codeword generator. As a second method for the arithmetic coding method, signal segments are coded by the arithmetic code as a single codeword (i.e, with an end-of-sequence termination) by the first codeword generator 109, alternated by the corresponding independent encoding of a set of model indices (also with an end-of-sequence termination) by the second codeword generator 100. As a third method, fixed-rate coding is used for the model index and arithmetic coding is used for the signal samples, and each fixed-length codeword for the model index is inserted as soon as the encoding of a corresponding signal segment of samples is completed in the sense that the signal segment of samples can be decoded from the bitstream. The third method results in an arithmetic code for the signal samples that is interlaced with model index samples, without requiring additional bits for separating the bitstreams containing information for the dequantizer 204 and the modeller 213.

The reconstructed signal 121 is formed by processing the quantized segments produced by the quantizer 104 in the reconstructing means 117, which reconstructing means 117 includes components performing the inverse operations of the components of the pre-processing means 125. In particular, the reconstructing means 117 may include a denormalization means 105 for performing a denormalization of the signal segment, an inverse transformer 106 for applying an inverse transform to the denormalized signal segment, a second correcting means or adder 115 that adds back the zero-input response to the inversely transformed signal segment, and an inverse weighting filter 108 for applying an inverse filter to the corrected signal segment. The reconstruction operators may also be updated from the reconstructed signal 121. It is to be noted that the normalization means and the correcting means are optional components of the reconstructed means 117.

Figure 3:
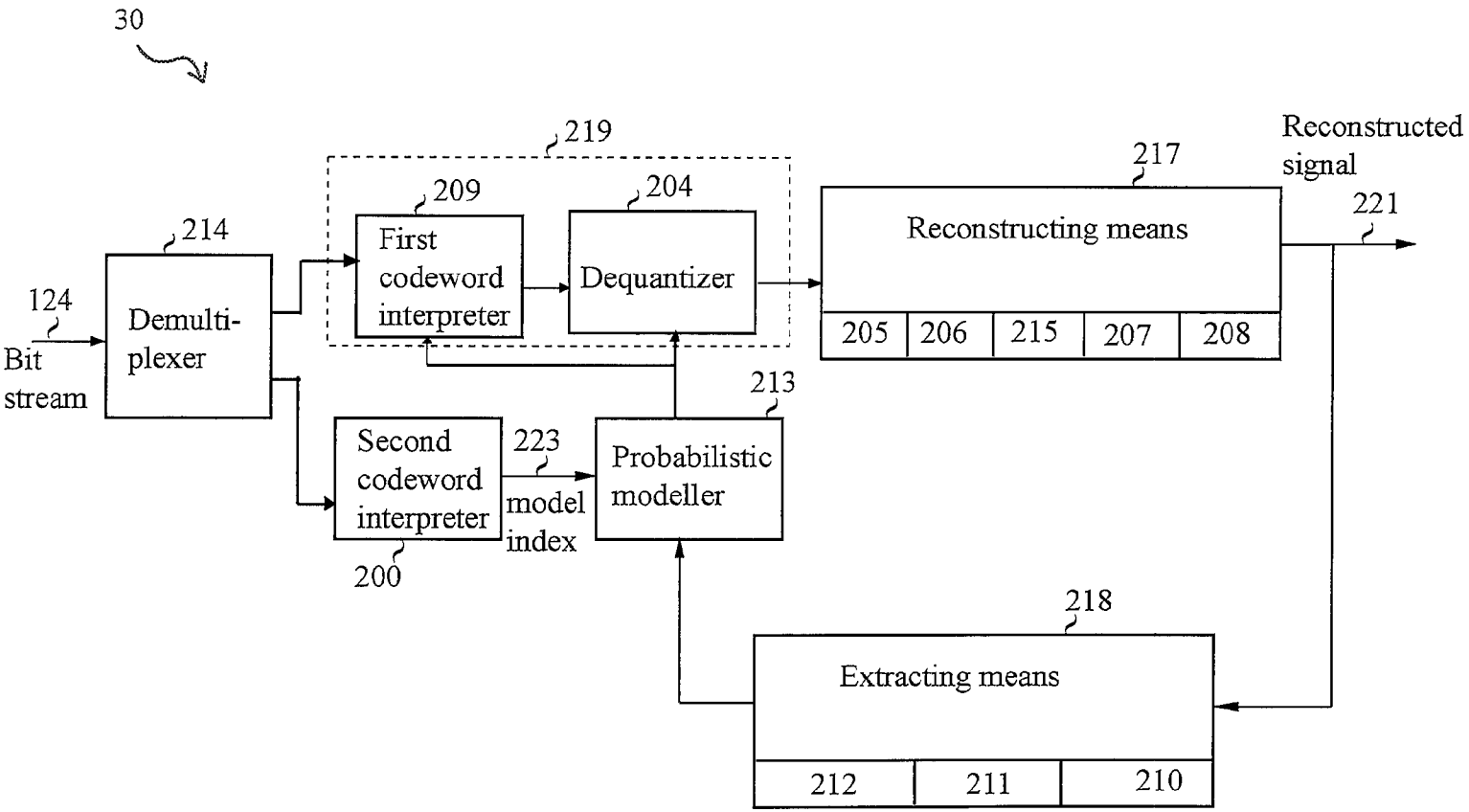
FIG. 3 shows an apparatus for decoding a sequence of coded data according to an embodiment of the present invention.

With reference to FIG. 3, a decoder or apparatus 30 for decoding will now be described in accordance with an embodiment of the present invention.

FIG. 3 shows a decoder or apparatus 30 for decoding a bit stream 124 of coded data which may be received from the coder or apparatus 10 or 20 for encoding described with reference to FIG. 1 or 2, respectively. The bit stream is received by a demultiplexer 214 that splits the bit stream in information about a combined distribution model and a bit stream corresponding to a current sequence of coded data, i.e. quantization indices for a current signal segment of the input signal 120, pre-processed by the pre-processing means 125 such as described with reference to FIGS. 1 and 2. The current sequence of coded data is provided to a decoder 219, which uses a combined distribution model provided by a modeller 213 in order to output a sequence of decoded data. The quantization indices input in the decoder 219 specify quantized subsegments. The modeller 213 obtains the combined distribution model by adding at least one first distribution model with which model parameters are associated and at least one fixed distribution model. The model parameters are extracted by an extracting means 218 from an existing part of a reconstructed signal 221 which corresponds to past sequences of the bit stream 124. The reconstructed signal 221 is generated by a reconstructing means 217 which will be described in more detail with reference to FIG. 4 in the following. The information about the combined distribution model, which may be received in the form of a model index, includes at least weighting coefficients and is provided to the modeller 213.

The modeller 213 can then affect the weighting coefficients to the corresponding distribution models (the first and fixed distribution models) in accordance with the model index 223 for obtaining the combined distribution model.

The extracting means 218 allows the probabilistic modeller 213 to create a combined distribution model in a similar manner as the extracting means 118 described with reference to FIG. 1 or 2.

According to an embodiment, the decoder 219 includes a first codeword interpreter 209, which outputs quantization indices, and a dequantizer 204, which outputs the sequence of decoded data, i.e. the quantized current signal segment. Thus, the dequantizer computes the quantized data from the quantization indices.

The reconstructing means 217 performs the inverse process of the pre-processing means 125 described with reference to FIG. 1 or 2 on a segment-by-segment basis, thereby rendering a reconstructed signal 221 in response to the sequence of decoded data provided by the dequantizer 204. The reconstructed signal 221 can then output a part of the reconstructed signal 221 from the current sequence of decoded data, thereby the reconstructed signal 221 is continuously updated.

A second codeword interpreter 200 may be arranged between the demultiplexer 214 and the modeller 213 in order to decode the coded model index or coded information about the combined distribution model and provide this information or model index to the modeller 213. The model index specifies information about the combined distribution model and in particular a set of weighting coefficients. As a result, the modeller provides a combined distribution model 424 to the first codeword interpreter 209 and/or to the dequantizer 204. For the constrained-resolution case, the combined distribution model specifies the set of reconstruction points used in the dequantizer 204. The first codeword interpreter 209 provides the index for a particular point and this point is then determined in the dequantizer 204. The set of reconstruction points of the constrained-resolution quantizer is spaced with a spacing that is the inverse of the local density of reconstruction points as computed by standard high-rate quantization theory based on the combined distribution model 424 provided by the modeller 213. For the constrained-entropy case, the index information is used to determine the correct quantization index in the first codeword interpreter 209 using the combined distribution model provided by the modeller 213. This quantization index is then used in the dequantizer 204 to select one of the reconstruction points of the uniform constrained-entropy quantizer. The reconstruction points of the dequantizer 204 are identical to the reconstruction points of the quantizer 104, and it could be considered that the dequantizer 204 is identical to a component of the quantizer 104.

Figure 4:
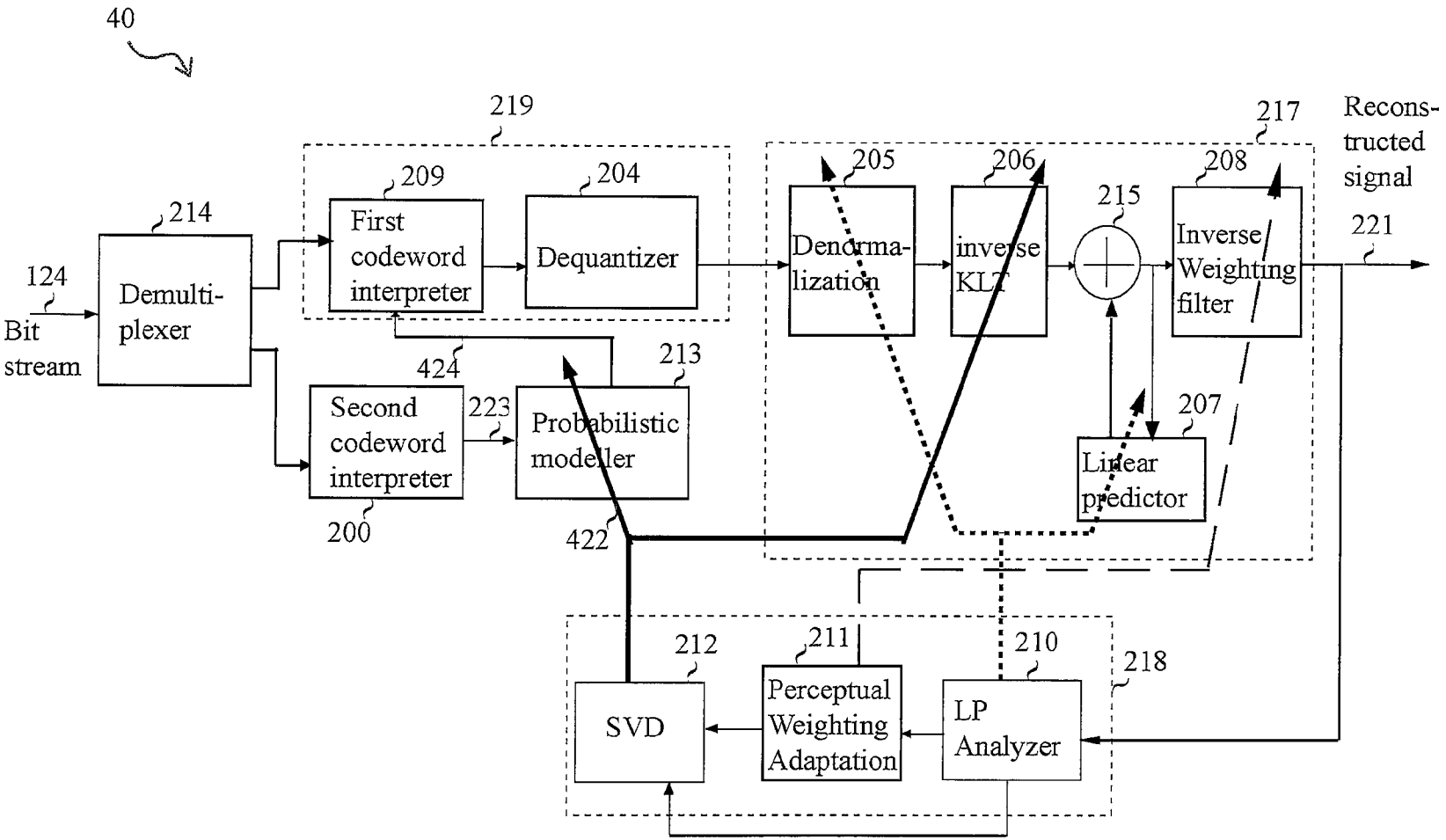
FIG. 4 shows an apparatus for decoding a sequence of coded data according to another embodiment of the present invention.

FIG. 4 shows a system or apparatus 40 for decoding a bit stream 124 of coded data, which apparatus 40 is equivalent to the apparatus 30 described with reference to FIG. 3 except that examples of a reconstructed means 217 and an extracting means 218 are illustrated in more detail.

The reconstructed means 217 is equivalent to the reconstructed means 117 described with reference to FIG. 2 and may include a denormalization means 205, an inverse transformer 206 such as an inverse KLT transformer 206, a correcting means or adder 215, a response computer 207 and an inverse weighting filter 218.

The extracting means 218 is equivalent to the extracting means 118 described with reference to FIG. 2 and may include a LP analyser 210, a perceptual weighting adaptation means 211 and an SVD 212.

Figure 5:
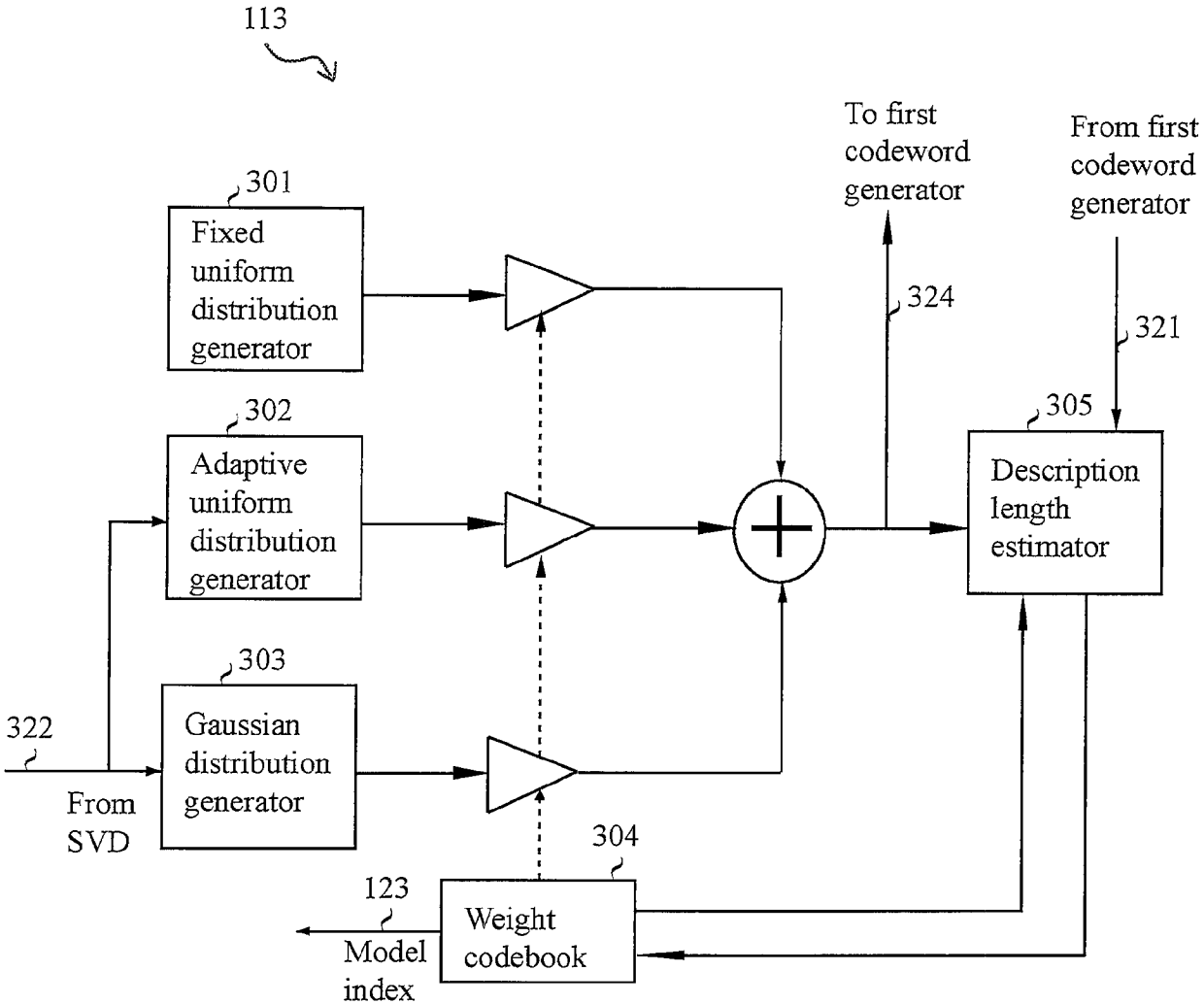
FIG. 5 shows a modeller according to an embodiment of the present invention, which modeller is used in an apparatus for encoding in accordance with the present invention.

An example of a modeller 113 of the apparatus 10 or 20 for encoding, such as described with reference to FIG. 1 or 2, will now be described with reference to FIG. 5.

For each signal segment, the probabilistic modeller 113 determines a probabilistic model or combined distribution model for the quantization indices. Through the SVD operator 112, the probabilistic model is based on the autoregressive signal model corresponding to the linear prediction coefficients estimated by the LP analyzer 110 and the perceptual weighting computed in adaptation 115.

Once a probabilistic model for the signal segment is defined, the entropy coder 109 can define the code words that are to be transmitted or stored. The optimal description length used to describe the current signal segment with a particular probabilistic model can be estimated via a summation of the code length of the quantized signal and the length used for describing the model. Thus, the resulting length, called description length in the following, can be used as a means for selecting the model. For the scalar quantizer case, the description length may be evaluated based on high-rate quantization theory assumptions (which correspond to an approximation of most normal cases) and be expressed as:

$$l_i = \max\left\{-\sum_j \log\left(p_{S_j|M}(s_j \mid M_i)\Delta\right), 0\right\} + L(M_i), \tag{8}$$

where $p_{s_j|M}(\cdot|M_i)$ denotes the probability density of the scalar signal component $s_j$ given a particular model $M_i$, where $\Delta$ is the quantization step size and where $L(M_i)$ is the description length needed for the parameters of the particular model. The sum in equation (8) is over all scalar signal components comprising the signal segment of signal 120 after preprocessing (including transformation) and quantization. Note that the set of $p_{s_j|M}(\cdot|M_i)$, together with the KLT, the zero-input response and the normalization factor form a probabilistic model of the current signal segment. Albeit inaccurate at low rates, equation (8) is convenient because of its low computational complexity. However, equation (8) may be replaced by a more accurate formula if necessary. Equation (8) clearly illustrates the effect of reverse waterfilling, i.e. a component $p_{s_j|M}(s_j|M)$ with small variance relative to the step size is described with a rate equal to zero.

If the entropy coder would only rely on an autoregressive Gaussian model estimated with a backward adaptive linear predictive analysis, then $L(M)=0$ and there may be signal segments for which the model is poor, i.e. the description length resulting from equation (8) is large. However, the probability density model used in the present invention is a mixture (weighted sum) of a backward adapted probability density and one or more other component probability densities.

The combined distribution model may be selected among a plurality of models $M=\{M_i\}$ such that the total description length over M is minimized, in accordance with the following equation:

$$l_{min} = \min_{i \in M}\left\{\max\left\{-\sum_j \log\left(p_{S_j|M}(s_j \mid M_i)\Delta\right), 0\right\} + L(M_i)\right\}. \tag{9}$$

Each joint probability density model is a mixture model resulting in a combined distribution model. The distribution models may share the same mixture components, wherein only the weights or weighting coefficients of the components vary, as illustrated in the following equation:

$$\prod_j p_{S_j|M}(s_j \mid M_i) = p_{S|M}(s \mid M_i) = \sum_{k=1}^{K} w_{ik}\, p_{S|\theta_k}(s \mid \theta_k), \tag{10}$$

where the coefficient set $\{w_{i1}, \ldots, w_{ik}\}$ correspond to the weighting coefficients affected to the various components of the combined distribution model. As $p_{S|M}(s|M_i)$ represents a probability distribution, the sum of the weights or weighting coefficients is equal to unity. Thus, the set of weights or weighting coefficients forms a probability distribution for the component probability densities. As an example, two or three component probability densities may be used. In a first example, the combined distribution model is obtained by adding at least one first distribution model with which the model parameters extracted from the reconstructed signal 121 are associated and at least one fixed distribution model. Weighting coefficients are affected to and multiplied by each of these distribution models. The sum of these weighted distribution models results in the combined distribution model. In a second example, the combined distribution model is obtained by adding at least one first Gaussian distribution model generated in the first distribution generator 303 based on the autoregressive model parameters extracted from the reconstructed signal 121, at least one fixed uniform distribution model generated in the second distribution generator 301 and at least one adaptive uniform distribution model generated in the adaptive distribution generator 302, selected in response to the extracted autoregressive model parameters. Similarly, weighting coefficients are affected to and multiplied by each of the corresponding distribution models for a summation. However, any arbitrary number of component probability densities may be used.

It is preferable that a quantized version of the weighting coefficients or a weight vector representing the weighting coefficients is transmitted or is stored together with the sequence of coded data. A constrained-entropy quantization procedure may be used to quantize the weight vectors in order to optimize performance. However, since in a practical application the quantizer weight vectors have a low bit rate, it is reasonable to use a constrained-resolution quantizer for the weight vectors even when constrained-entropy coding is used for the signal segments. In this case the number $L(M_i)$ in equation (8) is fixed. In the example shown in FIG. 5, three component distribution densities, generated in a first 303, a second 301 and a third 302 generator, are weighted and summed before the resulting mixture density function, i.e. the combined distribution model, is used to estimate the description length in a description length estimator 305. The estimator 305 receives a segment of the preprocessed quantized signal 321 from the codeword generator 109, comprising the set of scalars $s_j$ for equation (8). The first generator 303 may generate a Gaussian distribution model obtained from the model parameters through the SVD operator 112. The model parameters are associated with the Gaussian model and may represent the variance of the Gaussian distribution. The second generator 301 may generate a fixed distribution model, which may be a uniform distribution with a range that equals the range of the digital representation of the input signal 120. The third generator 302 may generate an adaptive distribution model selected in response to the model parameters extracted from the reconstructed signal 121. As an example, the distribution model generated by the third generator 302 may be a uniform distribution which is adaptive with a range corresponding to 12 times the range of the standard deviation of the corresponding Gaussian distribution generated by the first generator 301. The uniform distribution components remove precision problems associated with the Gaussian density. In this example, one of the distribution models is adapted for large deviation and one of the other models is adapted for small deviation. In an exemplary embodiment, the weight vectors and codewords are affected to the distribution models by a weight codebook 304. The probabilistic modeller 113 searches through every entry or set of values of weighting coefficients of the weight codebook 304 and selects the set of weighting coefficients leading to the shortest description length. Then, the combined distribution model 324 which corresponds to the sum of the different distribution models generated by the generators 301-303, each of the model being multiplied by its respective weighting coefficient, is sent to the entropy coder 109.

Figure 6:
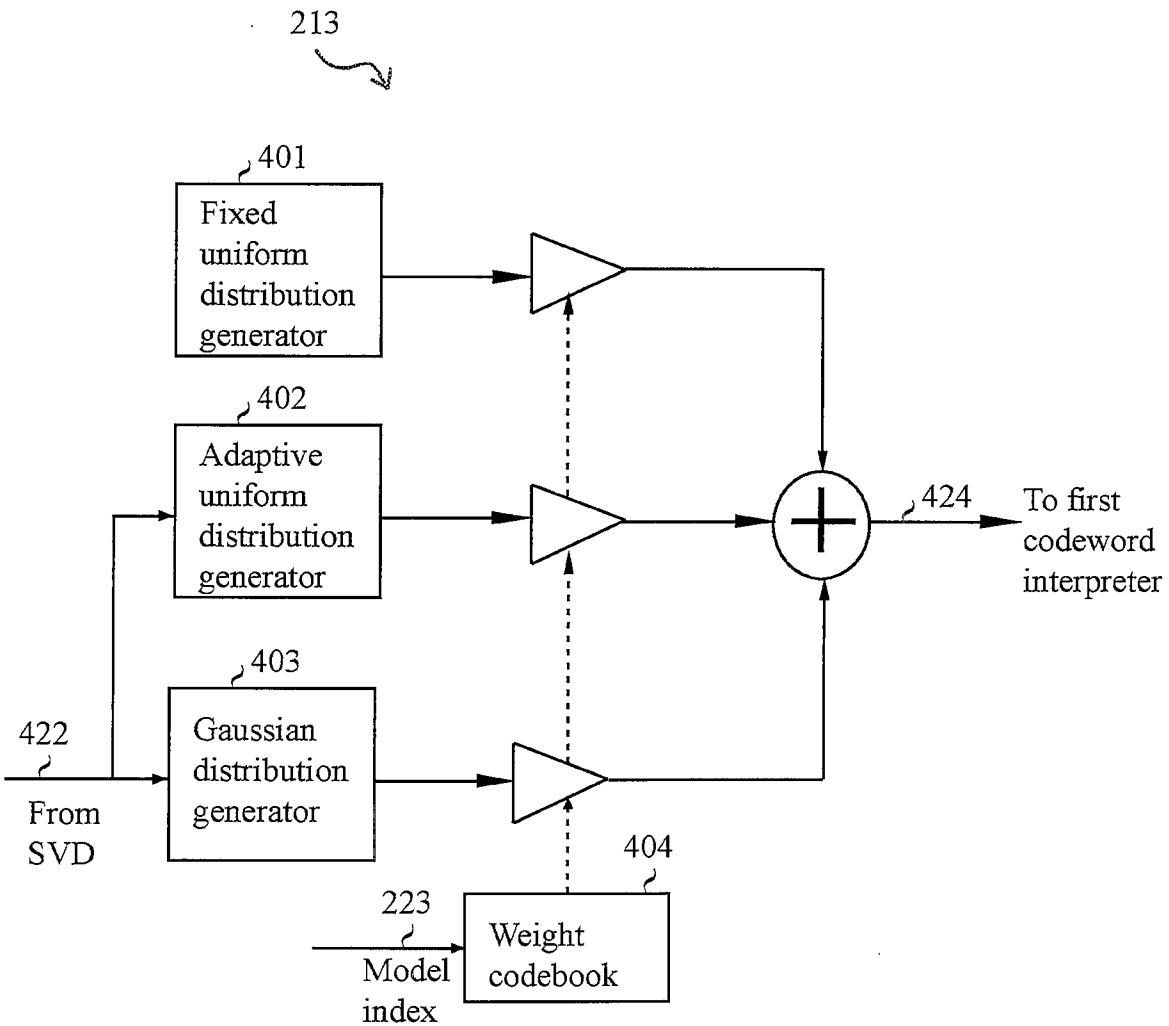
FIG. 6 shows a modeller according to another embodiment of the present invention, which modeller is used in an apparatus for decoding in accordance with the present invention.

With reference to FIG. 6, the modeller 213 of the apparatus 30 or 40 for decoding is described in more detail.

The probabilistic modeller 213 receives the model index 223 and generates the combined distribution model 424 used by the first codeword interpreter 209 and the dequantizer 204. The modeller 213 is equivalent to the modeller 113 described with reference to FIG. 5 except that the modeller 213 of the apparatus for decoding does not include a description length estimator. The modeller 213 includes a first generator 403 for generating a first Gaussian distribution model based on the autoregressive model parameters, a second generator 401 for generating a fixed distribution model and may further include a third generator 402 for generating an adaptive uniform distribution model selected in response to the autoregressive model parameters. These model parameters are extracted by the extracting means 218 from the reconstructed signal 221 generated by the reconstructing means 217.

The first distribution model 403 may be a Gaussian distribution model and the extracted model parameters provided by the extracting means 218 are parameters of the Gaussian distribution model.

The fixed distribution model may be a uniform signal model, which is characteristic of the input signal 120.

The weighting coefficients are affected to each of these distribution models in accordance with the model index 223 decoded by the second codeword interpreter 200.

Although backward adaptive encoding enables to reduce bit rate, this type of encoding may present poor robustness against channel errors in the form of bit errors and/or packet loss. One of the reasons may be that the reconstructed signal segment is used for analysis. This type of error will be referred to as error propagation through analysis in the following. Another reason may be that the subtraction of the zero-input response propagates past signal errors. This type of errors decays if the filters are stable and will be referred to as error propagation through filtering in the following.

First, alternatives to make the encoding robust to error propagation through analysis are presented. The basic concept is to turn of the component distributions of the combined distribution that cause error propagation through analysis. These distributions that cause error propagation through analysis are the distributions that required parameter extraction from the past reconstructed signal. It is noted that the set of weighting coefficients $\{w_{i1}, \ldots, w_{ik}\}$ determines whether the mixture probabilistic model, i.e. the combined distribution model with weight index i, is dependent on the backward adaptation probabilistic density, i.e. the distribution model generated by the first generator 403. If the weighting coefficient for a probabilistic density is zero for a time segment longer than the window length of the backward adaptive analysis, then the error propagation through analysis is stopped. This can be implemented by biasing the set of weights if channel errors are anticipated. If $w_{i1}$ represents the weighting coefficient of the first distribution model generated in the first generator 403, i.e. the component model corresponding to the backward adaptive component of the distribution density, denoted model i, whenever a model i with $w_{i1}=0$ results in a rate increase in equation (8) over the best model that is lower than a threshold value, then this model i has no error propagation through analysis caused by the distribution model generated in the first generator 403. The same reasoning holds for error propagation caused by the distribution model generated in 401. The threshold values can be adapted, either in real-time or off-line, such that a desired level of robustness is achieved. It is noted that as the quality of the reconstructed signal 121 does not vary with the combined distribution model used (the rate does), the bias can be enacted both during background or foreground signals.

Further, for improving the performance of the encoder 109 against error propagation through analysis, a plurality of fixed probabilistic signal models (distribution models) that are commonly seen in the input signal 120 may be introduced as components of the combined distribution model in addition to the fixed distribution model generated in by the third generators 302 and 402.

Error propagation through filtering is generally a lesser problem. Most common methods used to estimate autoregressive model parameters through linear-predictive analysis lead to stable filters, which implies that errors in the contributions of the zero-input response decay without additional effort. However, if a channel is particularly poor, it can be ensured that the zero-input response decays more rapidly by e.g. considering the zero-input response as a summation of responses to previous individual blocks. For each block the response can then be windowed, so that it has a finite support and, therefore, does not ring beyond a small number of samples. When this is done consistently at the encoder and the decoder, then error propagation through filtering is significantly diminished.

In addition, a computer readable medium having computer executable instructions for carrying out, when run on a processing unit, each of the steps of the method for encoding described above is provided, and a computer readable medium having computer executable instructions for carrying out, when run on a processing unit, each of the steps of the method for decoding described above is provided.

Although the invention above has been described in connection with preferred embodiments of the invention, it will be evident for a person skilled in the art that several modifications are conceivable without departing from the scope of the invention as defined by the following claims.

The invention claimed is:

1. A method for encoding an input signal, said method including the steps of:

generating a reconstructed signal from past signal segments of said input signal extracting model parameters from said reconstructed signal;

adding at least one first distribution model with which the extracted model parameters are associated and at least one fixed distribution model, wherein weighting coefficients are affected to each of these distribution models, for obtaining a combined distribution model;

encoding a current signal segment of said input signal into a sequence of coded data using said combined distribution model; and generating a bit stream including said sequence of coded data and information about said combined distribution model corresponding to said current signal segment.

2. The method as defined in claim 1, wherein the information about said combined distribution model is encoded as side information in the form of a model index specifying at least said weighting coefficients.

3. The method as defined in claim 1, wherein the weighting coefficients are selected for minimizing an estimated code length for said current signal segment.

4. The method as defined in claim 1, wherein the step of encoding includes the steps of:

quantizing said current signal segment using said combined distribution model; and encoding the quantized current signal segment into said sequence of coded data.

5. The method as defined in claim 1, wherein the step of encoding includes the steps of:

quantizing said current signal segment; and encoding the quantized current signal segment into said sequence of coded data using said combined distribution model.

6. The method as defined in claim 4, wherein the quantization cell size used for the step of quantizing a particular set of samples is constant.

7. The method as defined in claim 1, wherein the fixed distribution model is a uniform distribution model.

8. The method as defined in claim 1, wherein the first distribution model is a Gaussian distribution model and the extracted model parameters are parameters for said Gaussian distribution model.

9. The method as defined in claim 1, wherein said combined distribution model is a mixture model further including at least one adaptive distribution model selected in response to the extracted model parameters, to which adaptive distribution model a weighting factor is affected, and which weighted adaptive distribution model is added to the first and the fixed weighted distribution models for obtaining the combined distribution model.

10. The method as defined in claim 1, wherein the combined distribution model is selected from a plurality of combined distribution models in response to a code length of a subsegment of said current signal segment and a code length used for describing the distribution model of said reconstructed signal.

11. The method as defined in claim 1, wherein, prior to the step of generating a reconstructed signal, the method includes the steps of:

applying a perceptual filter to a signal segment of said input signal;

applying a transform to the filtered signal segment; and quantizing the transformed and filtered signal segment.

12. The method as defined in claim 11, wherein the step of generating a reconstructed signal includes the steps of:

applying an inverse transform to the quantized signal segment; and applying an inverse weighting filter to the inversely transformed signal segment.

13. The method as defined in claim 1, wherein the weighting coefficients are biased for minimizing error propagation.

14. The method as defined in claim 1, wherein the weighting coefficient affected to the first distribution model is biased towards a value of zero for minimizing error propagation.

15. The method as defined in claim 1, wherein the weighting coefficient affected to the first distribution model is compared with a threshold value below which the weighting coefficient is set to zero.

16. A non-transitory computer readable medium having computer executable instructions for carrying out each of the steps of the method as claimed in claim 1 when run on a processing unit.

17. An apparatus for encoding an input signal, said apparatus including:

a reconstructing means for generating a reconstructed signal from past signal segments of said input signal;

an extracting means for extracting model parameters from said reconstructed signal;

a modeller adapted to add at least one first distribution model generated by at least one first distribution generator with said model parameters and at least one fixed distribution model generated by at least one second distribution generator, wherein a weight codebook affects weighting coefficients to each of these distribution models, for obtaining a combined distribution model;

an encoder for encoding a current signal segment of said input signal into a sequence of coded data using the combined distribution model; and a multiplexer receiving information about the combined distribution model from the modeller and the sequence of coded data from the encoder for generating a bit stream corresponding to said current signal segment.

18. The apparatus as defined in claim 17, wherein a second codeword generator encodes information about the combined distribution model as side information in the form of a model index specifying at least said weighting coefficients.

19. The apparatus as defined in claim 17, wherein said weight codebook selects the weighting coefficients for minimizing a code length estimated by an estimator.

20. The apparatus as defined in claim 17, wherein the encoder includes:

a quantizer for quantizing said current signal segment using said combined distribution model; and a first codeword generator for encoding the quantized current signal segment into said sequence of coded data.

21. The apparatus as defined in claim 17, wherein the encoder includes:

a quantizer for quantizing said current signal segment; and a first codeword generator for encoding the quantized current signal segment into said sequence of coded data using said combined distribution model.

22. The apparatus as defined in claim 20, wherein the quantizer is a scalar quantizer.

23. The apparatus as defined in claim 20, wherein the quantization cell size of said quantizer is constant for a particular set of samples.

24. The apparatus as defined in claim 17, wherein the fixed distribution model of the second distribution generator is a uniform distribution model.

25. The apparatus as defined in claim 17, wherein the first distribution model of the first distribution generator is a Gaussian distribution model and the extracted model parameters are parameters for said Gaussian distribution model.

26. The apparatus as defined in claim 17, wherein the modeller further includes at least one adaptive distribution generator for generating an adaptive distribution model selected in response to the extracted model parameters, wherein said weight codebook affects a weighting coefficient to said adaptive distribution model, and wherein said modeller obtains the combined distribution model by adding, each of the distribution models being multiplied by its corresponding weighting coefficient, said adaptive distribution model to the first and fixed distribution models.

27. The apparatus as defined in claim 17, wherein the modeller selects the combined distribution model from a plurality of combined distribution models in response to a code length of a subsegment of said current signal segment and a code length used for describing the distribution model of said reconstructed signal .

28. The apparatus as defined in claim 20, wherein, prior to be subjected to the reconstructing means, the input signal is subjected to:

a perceptual weighting filter for filtering a signal segment;

a transformer for applying a transform to the filtered signal segment; and the quantizer of the encoder for quantizing the transforined signal segment.

29. The apparatus as defined in claim 28, wherein the reconstructing means includes:

an inverse transformer for applying an inverse transform to the quantized signal segment; and an inverse weighting filter for applying an inverse weighting filter to the inversely transformed signal segment.

30. The apparatus as defined in claim 29, further including:

a first correcting means arranged between said perceptual weighting filter and said transformer to perform a subtraction of zero input response to the filtered signal segment; and a second correcting means arranged between said inverse transformer and inverse weighting filter to perform an addition of zero input response to the inversely transformed signal segment.

31. The apparatus as defined in claim 29, further including:

a normalization means arranged between said transformer and said quantizer to perform a normalization of the transformed signal segment; and a denormalization means arranged between said quantizer and said inverse transformer to perform a denormalization of the inversely transformed signal segment.

32. The apparatus as defined in claim 30, further including a response computer for providing a zero-input response to the correcting means.

33. The apparatus as defined in claim 17, wherein said extracting means includes a linear predictive analyzer.

34. The apparatus as defined in claim 17, wherein said modeller biases the weighting coefficients for minimizing error propagation.

35. The apparatus as defined in claim 17, wherein said modeller biases the selection of the weighting coefficients of the distribution models that are based on the past reconstructed signals towards a value of zero for minimizing error propagation.

36. The apparatus as defined in claim 17, wherein said modeller compares the weighting coefficient of the first distribution model with a threshold value below which it sets the weighting coefficient to zero.

37. A method for decoding a bit stream of coded data, said method including the steps of:

extracting from said bit stream a current sequence of coded data and a coded model index including information about a combined distribution model, which information includes weighting coefficients;

extracting model parameters from an existing part of a reconstructed signal corresponding to past sequences of said bit steam;

adding at least one first distribution model with which said model parameters are associated and at least one fixed distribution model, wherein the weighting coefficients are affected to the corresponding distribution models in accordance with the model index, for obtaining a combined distribution model;

decoding said current sequence of coded data into a current sequence of decoded data using said combined distribution model; and generating a part of the reconstructed signal from said current sequence of decoded data.

38. The method as defined in claim 37, wherein the model index is received as side information.

39. The method as defined in claim 37, wherein the fixed distribution model is a uniform distribution model.

40. The method as defined in claim 37, wherein the first distribution model is a Gaussian distribution model.

41. The method as defined in claim 37, wherein the combined distribution model is a mixture model further including at least one adaptive distribution model selected in response to said model parameters, to which adaptive distribution model a weighting factor is affected in accordance with said model index, and which weighted adaptive distribution model is added to the first and fixed weighted distribution models for obtaining the combined distribution model.

42. The method as defined in claim 37, wherein the step of decoding includes the steps of:

interpreting a codeword for the coded data; and dequantizing the decoded data based on said codeword.

43. The method as defined in claim 37, further including a step of interpreting a codeword for the coded model index for extracting the model index.

44. The method as defined in any one of claim 42, wherein the step of generating a reconstructed signal includes the steps of:

applying an inverse transform to the dequantized data; and applying an inverse weighting filter to the inversely transformed data.

45. The method as defined in claim 44, wherein, between the step of dequantizing and the step of applying an inverse transform, the step of generating a reconstructed signal further includes the step of:

performing a denormalization of the dequantized data.

46. The method as defined in claim 44, wherein, between the step of applying an inverse transform and the step of applying an inverse weighting filter, the step of generating a reconstructed signal further includes the step of:

correcting the data by performing an addition of the zero input response to the inversely transformed data.

47. A non-transitory computer readable medium having computer executable instructions for carrying out each of the steps of the method as claimed in claim 37 when run on a processing unit.

48. An apparatus for decoding a bit stream of coded data, said apparatus including:

a demultiplexer for demultiplexing said bit stream in a current sequence of coded data and a model index including information about a combined distribution model, which information includes weighting coefficients;

an extracting means for extracting model parameters from an existing part of a reconstructed signal corresponding to past sequences of said bit steam;

a modeller adapted to add at least one first distribution model generated with the extracted model parameters by at least one first generator and at least one fixed distribution model generated by at least one second generator, wherein a weight codebook affects the weighting coefficients to the distribution models in accordance with said model index, for obtaining a combined distribution model;

a decoder for decoding said current sequence of coded data into a current sequence of decoded data using said distribution model; and a reconstructing means for generating a part of the reconstructed signal from said current sequence of decoded data.

49. The apparatus as defined in claim 48, wherein a demultiplexer receives the coded model index as side information.

50. The apparatus as defined in claim 48, wherein the fixed distribution model is a uniform distribution model.

51. The apparatus as defined in claim 48, wherein the first distribution model is a Gaussian distribution model and the extracted model parameters are parameters of the Gaussian distribution model.

52. The apparatus as defined in claim 48, wherein said modeller further includes at least one third generator for generating at least one adaptive distribution model with the extracted model parameters, wherein said weight codebook affects a weighting coefficient to said adaptive distribution model in accordance with said model index, and wherein said modeller obtains the combined distribution model by adding, each of the distribution models being multiplied by its corresponding weighting coefficient, said adaptive distribution model to the first and fixed distribution models.

53. The apparatus as defined in claim 48, wherein said decoder includes a first codeword interpreter and a dequantizer for decoding the current sequence of coded data.

54. The apparatus as defined in claim 48, further including a second codeword interpreter for interpreting a codeword corresponding to the coded model index.

55. The apparatus as defined in claim 53, wherein said reconstructing means includes:

an inverse transformer for applying an inverse transform to the dequantized data; and an inverse weighting filter for applying an inverse weighting to the inversely transformed data.

56. The apparatus as defined in claim 55, wherein a denormalization means is arranged between said dequantizer and said inverse transformer for performing a denormalization of the dequantized data.

57. The apparatus as defined in claim 55, wherein a correcting means is arranged between said inverse transformer and said inverse weighting filter for performing an addition of zero input response to the inversely transformed data.

58. The apparatus as defined in claim 57, further including a linear predictor for providing the zero-input response to said correcting means.

59. The apparatus as defined in claim 48, wherein said extracting means includes a linear predictive analyzer.

* * * * *